US010685772B2

(12) United States Patent
Ettl

(10) Patent No.: US 10,685,772 B2
(45) Date of Patent: Jun. 16, 2020

(54) TRANSFORMER WITH INSERTABLE HIGH VOLTAGE CONDUCTOR

(71) Applicant: SIEMENS AKTIENGESELLSCHAFT, Munich (DE)

(72) Inventor: Christian Ettl, Weiz (AT)

(73) Assignee: Siemens Aktiengesellschaft, Munich (DE)

( * ) Notice: Subject to any disclaimer, the term of this patent is extended or adjusted under 35 U.S.C. 154(b) by 640 days.

(21) Appl. No.: 15/159,324

(22) Filed: May 19, 2016

(65) Prior Publication Data

US 2017/0316862 A1 Nov. 2, 2017

(30) Foreign Application Priority Data

Apr. 29, 2016 (DE) ..... 10 2016 207 405

(51) Int. Cl.

| | |
|---|---|
| ***H01F 27/10*** | (2006.01) |
| ***H01F 27/04*** | (2006.01) |
| ***H01F 27/02*** | (2006.01) |
| ***H01F 27/12*** | (2006.01) |
| ***H01R 33/94*** | (2006.01) |

(52) U.S. Cl.

CPC ..... *H01F 27/04* (2013.01); *H01F 27/025* (2013.01); *H01F 27/12* (2013.01); *H01R 33/94* (2013.01)

(58) Field of Classification Search

USPC ..... 336/58, 55, 56, 57, 61

See application file for complete search history.

(56) References Cited

U.S. PATENT DOCUMENTS 1,859,969 A * 5/1932 Jansson ..... H01F 27/40 218/91
3,621,426 A * 11/1971 Bennon ..... H01F 27/002 336/58

(Continued)

FOREIGN PATENT DOCUMENTS

DE 1282170 B 11/1968
DE 102007022641 A1 11/2008

(Continued)

OTHER PUBLICATIONS

Klein et al., "A New Separable 170 kV Outdoor Bushing System Created a Multi-Purpose Transformer or Switchgear", PFISTERER Kontaktsysteme GmbH & Co. KG, 2006, www.pfisterer.com.

*Primary Examiner* — Elvin G Enad
*Assistant Examiner* — Kazi S Hossain
(74) *Attorney, Agent, or Firm* — Laurence Greenberg; Werner Stemer; Ralph Locher

(57) ABSTRACT

An electrical appliance for connection to a high-voltage network has a housing that is fillable with an insulating liquid, in which housing a core with at least one winding is arranged, and a bushing plug-in socket fixed to the housing and a high-voltage bushing insertable into the bushing plug-in socket. The electrical appliance is also able to be used at higher voltages, in that the high-voltage bushing has a fixing section, with which the high-voltage bushing can be fixed to the housing and/or to the bushing plug-in socket and from which the high-voltage bushing extends with a column section in a longitudinal direction over a length L2 towards a high-voltage terminal. The length L2 is greater than three meters.

6 Claims, 4 Drawing Sheets

(56) References Cited

U.S. PATENT DOCUMENTS

| | | | | |
|---|---|---|---|---|
| 3,914,467 | A * | 10/1975 | Akao | C08G 59/18 427/116 |
| 4,298,853 | A * | 11/1981 | Philp | H01F 37/005 336/212 |
| 6,696,925 | B1 * | 2/2004 | Aiello, Jr. | H01F 27/002 340/12.38 |
| 8,455,763 | B2 | 6/2013 | Dais et al. | |
| 8,653,367 | B2 | 2/2014 | Brendel | |
| 2012/0071014 | A1 * | 3/2012 | Dais | H01B 17/28 439/181 |
| 2013/0033349 | A1 * | 2/2013 | Takano | H01F 27/04 336/94 |
| 2015/0372468 | A1 * | 12/2015 | Motley | H01F 38/20 336/105 |
| 2016/0118186 | A1 * | 4/2016 | Frimpong | G01H 1/00 307/119 |

FOREIGN PATENT DOCUMENTS

| | | | |
|---|---|---|---|
| EP | 2445321 | A1 | 4/2012 |
| FR | 2113911 | A1 | 6/1972 |
| JP | S60154511 | A | 8/1985 |

* cited by examiner

TRANSFORMER WITH INSERTABLE HIGH VOLTAGE CONDUCTOR

BACKGROUND OF THE INVENTION

Field of the Invention

The invention relates to an electrical appliance for connection to a high-voltage network with a housing fillable with an insulating liquid, in which housing a core with at least one winding is arranged, a conductor plug-in socket fixed to the housing and a high voltage conductor insertable into the conductor plug-in socket.

Such an electrical appliance is already known for example from DE 10 2007 022 641 A1. A transformer is disclosed there, which comprises plug-in sockets into which conductors for the connection of the transformer to a high-voltage network can be inserted. The transformer is constituted as a so-called mobile transformer, which is designed such that it can be transported between different sites with the least possible assembly outlay whilst maintaining a specified profile. The previously known electrical appliance, however, has the drawback that the insertable conductors are designed only for voltages in the low high-voltage range.

BRIEF SUMMARY OF THE INVENTION

The problem of the invention is to make available an electrical appliance of the type mentioned at the outset which can also be used at higher voltages.

The invention solves this problem in that the high voltage conductor comprises a fixing section, with which said high voltage conductor can be fixed to the housing and/or to the conductor plug-in socket and from which said high voltage conductor extends with a column section in a longitudinal direction over a length L2 towards a high-voltage terminal, length L2 being greater than three meters.

According to the invention, an electrical appliance, for example a transformer or a choke, is made available, which is designed for voltages above 150 kV. The high voltage conductor is correspondingly dimensioned for this purpose. In particular, the high voltage conductor comprises a fixing section, with which the fixing or fastening of the high voltage conductor to the housing of the electrical appliance is enabled. In order to provide the necessary dielectric strength for higher voltages, a column section of the high voltage conductor, which extends from the fixing section to a high-voltage terminal at the free end of the high voltage conductor in the longitudinal direction, has a length L2 of over 3 meters. High voltage conductors in this voltage range have hitherto not been constituted as insertable components. The electrical insulation required for this was rated as too costly. According to the invention, however, an electrical appliance with an insertable conductor also in higher voltage ranges is made available for the first time. The weights thereby occurring are taken up by the fixing section.

The column section expediently extends normal or at right angles to a horizontal housing cover of the housing, so that the weight of the high voltage conductor is introduced directly from above, i.e. vertically, into the conductor plug-in socket. The inherent weight of the conductor thus ensures a high pressing force inside the plug-in socket, so that good insulation is thus provided by a solid composite. The high voltage conductor is advantageously connected to the conductor plug-in socket by means of a suitable detachable connection, for example a screw-type connection.

According to a preferred embodiment, the high voltage conductor runs above a plug-in section, which is provided for introduction into the conductor plug-in socket. In other words, the high voltage conductor comprises a plug-in section also extending in said longitudinal direction, with which the high voltage conductor extends into the conductor plug-in socket over a length L1, length L1 being less than 600 mm. In the context of this embodiment of the electrical appliance according to the invention, the plug-in section of the high voltage conductor has been shortened with respect to comparable high voltage conductors in the same voltage range. This shortening enables a conductor plug-in socket which is constituted correspondingly shorter and which, in other words, extends less deeply into the housing of the electrical appliance, i.e. into its oil chamber. The assembly of a current transformer on the conductor is not required in this embodiment.

According to a further development of the invention that is expedient in this regard, each conductor plug-in socket comprises a fixing section for the fixing to the housing, wherein a hollow receiving section made of an electrically non-conductive insulating material extends into the housing, wherein a metallic contact part is arranged in a closed and tapered end region of the receiving section, said metallic contact part extending through the insulating material of the receiving section or lengthening the latter to the closed end region. According to this embodiment of the invention, each conductor plug-in socket has an open end roughly at the level of the housing cover and enables the insertion of the plug-in section of the high voltage conductor. A receiving section extends in the insertion direction from the fixing section of the conductor plug-in socket into the interior of the housing, wherein the receiving section is produced from an insulating material, which provides the necessary insulation between the contact piece lying at a high-voltage potential during operation and the housing of the transformer, which is at an earth potential. In order to provide the required dielectric strength here, the receiving section and the plug-in section are constituted with a mutually complementary shape, so that the plug-in section is pressed firmly against the inner wall of the receiving section as a result of the inherent weight of the high voltage conductor, in order thus to prevent voltage peaks between the high voltage conductor and the plug-in socket.

The contact part is advantageously connected to a winding via a winding connecting line extending inside the housing. As a result of the insertion of the high voltage conductor into the plug-in socket, the high-voltage conducting element of the high voltage conductor lies against the contact part, so that the high-voltage terminal of the high voltage conductor is connected via the winding connecting line to a winding of the electrical appliance.

According to a preferred embodiment of the invention, the winding connecting line is provided with a current transformer. As a result of the fact that the current transformer is arranged inside the housing, the current transformer no longer has to be integrated into the cable bundle in a costly manner during the assembly of the electrical appliance on site. In other words, the electrical appliance according to the invention can quickly be put into operation on site. Costly assembly of current transformers is avoided with this embodiment. Assembly openings are expediently provided in the housing in order to enable access to the current transformer or transformers after the draining of the insulating liquid.

According to a preferred embodiment, the plug-in section of the high voltage conductor is sheathed by a viscous insulator, a high-voltage conducting element extending through the viscous insulator or, in other words, the sheathing at the free end of the plug-in section. The viscous or highly viscous insulator ensures, as an outer sheathing, adequate electrical insulation between the mutually adjacent insulating and dimensionally stable solids of the plug-in socket and the plug-in section. The insulator is expediently a pasty oily substance with flow properties. As a result of the flow properties, the viscous insulator is pressed into the joint between the plug-in section of the high voltage conductor and the receiving section of the conductor plug-in socket and fills the latter completely. To accommodate possible excess viscous insulator, the receiving section comprises a sufficiently large additional volume with free spaces, into which the viscous insulator can be pressed. Air inclusions between the plug-in section and the receiving section with consequent high electrical field strengths can thus be prevented.

BRIEF DESCRIPTION OF THE SEVERAL VIEWS OF THE DRAWING

Further expedient embodiments and advantages of the invention are the subject-matter of the following description of examples of embodiment making reference to the figures, wherein identical reference numbers relate to identically acting components and wherein.

DESCRIPTION OF THE INVENTION

Figure 1:
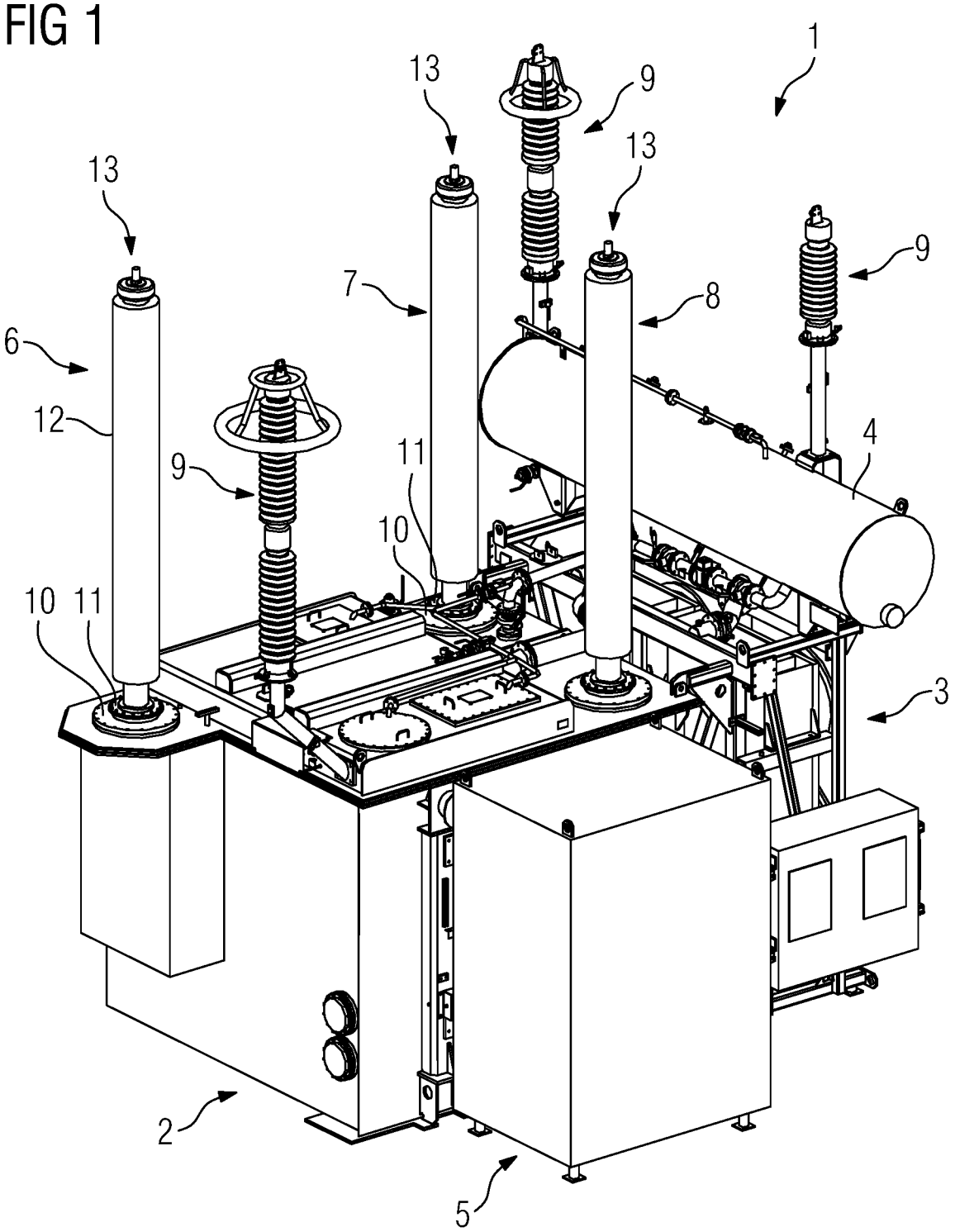
FIG. 1 shows an example of embodiment of the electrical appliance according to the invention in a perspective representation.

FIG. 1 shows, in a perspective view, an example of embodiment of the electrical appliance according to the invention, which is constituted here as a transformer 1. Transformer 1 shown there comprises a housing 2, which is provided with a cooling module 3, an expansion vessel 4, an auxiliary current module 5 and high voltage conductors 6, 7, 8. The known components or modules are connected detachably to one another, so that they can easily be dismantled and transported independently of one another. For the protection of high voltage conductors 6, 7 and 8 and the active part of the transformer arranged in the housing, i.e. the high voltage winding connected to high voltage conductor 6 or 7 and the low voltage winding connected to high voltage conductor 8 and the core, the limbs whereof are surrounded by the respective windings, use is made of arresters 9, which inside their arrester housing comprise a non-linear resistor, which in the event of overvoltages switches from a non-conducting state into a conducting state and thus protects the components connected to it in parallel.

High voltage conductors 6, 7 and 8 are each constituted as insertable high voltage conductors and can be introduced with their plug-in end into matching conductor plug-in sockets 10. Conductor plug-in sockets 10 are constituted rotation-symmetrical and border a cavity lying open towards the housing cover but closed at one side, said cavity being constituted with a complementary shape to the plug-in section of respective high voltage conductor 6, 7, 8. Conductor plug-in sockets 10 are also fixed fluid-tight to housing 2, so that the internal space or oil chamber of single-phase transformer 1 is sealed hermetically, i.e. air- and liquid-tight, from the external atmosphere. Held at the closed end of the conductor plug-in socket is a conductor stud (not shown in the figures) as a contact part which, when high voltage conductor 6, 7 or 8 is introduced into respective conductor plug-in socket 10, is in conductive contact with the high-voltage conducting element extending through respective high voltage conductor 6, 7, 8. Said conductor stud extends into the interior of housing 2, i.e. into its oil chamber, where it is in contact with a winding connecting line, which thus connects the conductor plug-in socket electrically to the respective high or low voltage winding of transformer 1.

For the assembly and fixing of high voltage conductor 6, 7 or 8, the latter each comprise a fixing connection 11. A column section 12 extends from fixing connection 11 to a high-voltage terminal 13, which in the example of embodiment shown is an outdoor connection.

Figure 2:
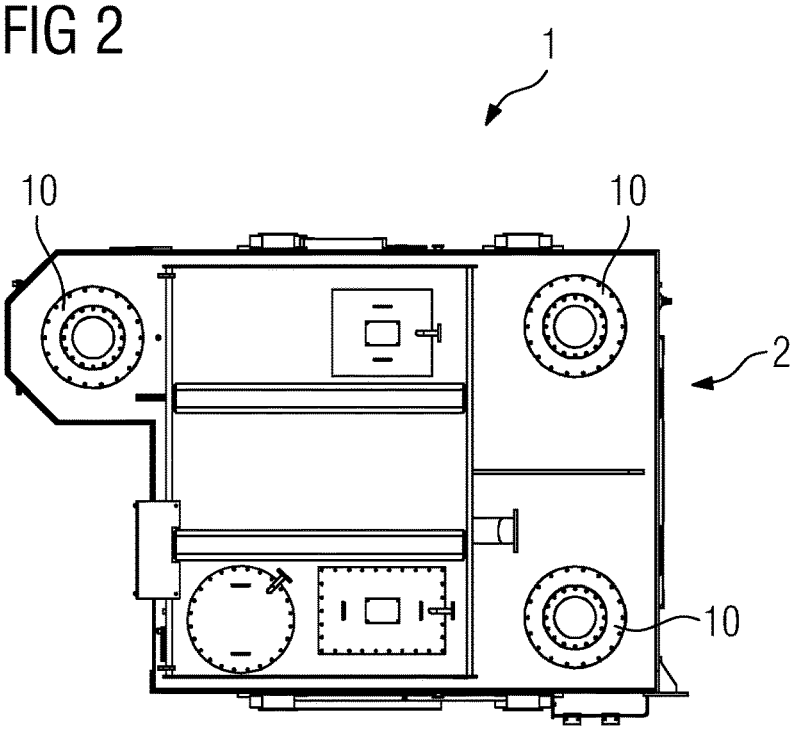
FIG. 2 shows the housing of the electrical appliance according to FIG. 1 in plan view.

FIG. 2 shows housing 2 of transformer 1 according to FIG. 1 in plan view. In this view, it can be seen that housing 2 comprises three plug-in sockets 10, which in FIG. 2 are all closed fluid-tight with a cover. Fluid-tight is understood here to mean that the cover closes the openings air- and liquid-tight by means of suitable sealing means.

Figure 3:
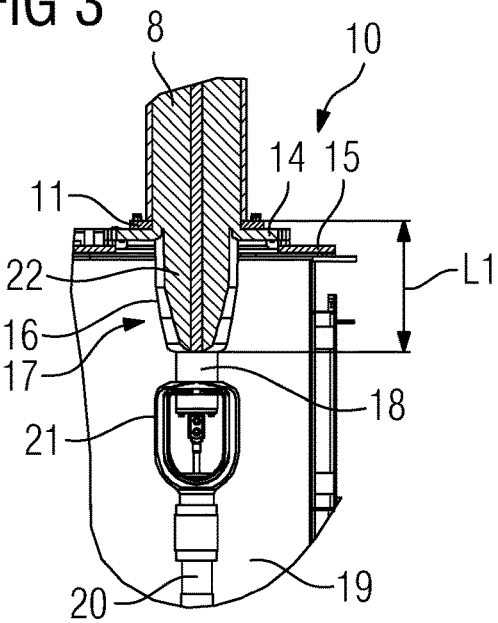
FIG. 3 shows a cross-sectional view of the plug-in section and of the plug-in socket including a shield.

FIG. 3 shows a conductor plug-in socket 10 and a high voltage conductor 8 in a sectional side view, wherein high voltage conductor 8 is introduced with a plug-in section 22 into conductor plug-in socket 10. It can be seen that conductor plug-in socket 10 comprises a fixing section 14, with which said conductor plug-in socket is mounted fixedly on a cover 15 of housing 2. Suitable screw-type connections, for example, are used for this purpose. In order to fix conductor plug-in socket 10 to housing 2 in an air- and liquid-tight manner, sealing means (not represented in the figures) are required, which are clamped between cover 15 and fixing section 14 constituted as a flange.

Figure 4:
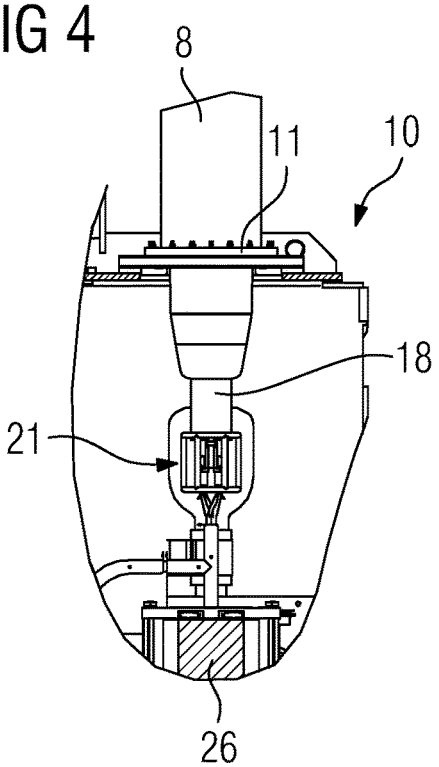
FIG. 4 shows a side view, not cut away, of the plug-in socket with a high voltage conductor and a current transformer.

Each conductor plug-in socket 10 further comprises a receiving section 16, which is made of an electrically non-conductive material. Receiving section 16 tapers towards a closed end 17. At closed end 17, the wall of receiving section 16 is penetrated by a stud-shaped contact part 18. At its section projecting into interior space 19 or the oil chamber of housing 2, contact part 18 is connected to a winding connecting line 20 and a spherical shielding cap 21 as a shield. Winding connecting line 20 is also provided with a current transformer 26, which is shown in FIG. 4. Current transformer 26 is thus fixedly installed in the housing and serves to detect an electrical current flowing via winding connecting line 20 to or from the respective winding.

Plug-in section 22 extends from fixing section 11 of high voltage conductor 8 into receiving section 16 of conductor plug-in socket 10. Plug-in section 22 is constituted with a complementary shape to receiving section 16, so that the two components lie with a perfect fit against one another and air or other inclusions can be prevented. The distance between the fixing section and the free end of high voltage conductor 8 is denoted as L1.

FIG. 4 shows conductor plug-in socket 10 in a side view not cut away. In this view, the embodiment of receiving section 16 and of current transformer 26 and its position relative to the remaining components can be seen particularly well. Moreover, the comments made in respect of FIG. 3 apply here correspondingly.

Figure 5:
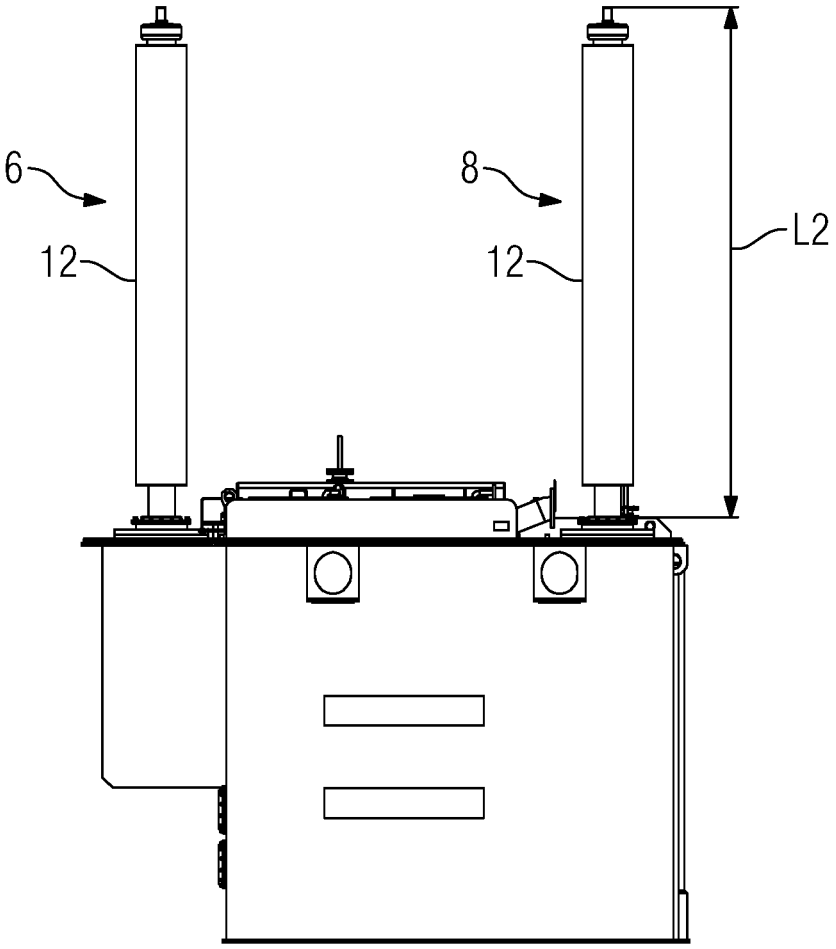
FIG. 5 shows the housing according to FIG. 2 in a side view with introduced high voltage conductors.

FIG. 5 shows housing 2 of transformer 1 according to FIG. 1 in a side view. In this view, the two high voltage conductors 6 and 8 can be seen, which are inserted into their assigned conductor plug-in sockets 10. In particular, it can be seen that column section 12 extends over a length L2, which according to the invention is greater than 3 meters, so that high voltage conductors 6, 8 are equipped for sufficiently high voltages and have a sufficiently high dielectric strength.

Figure 6:
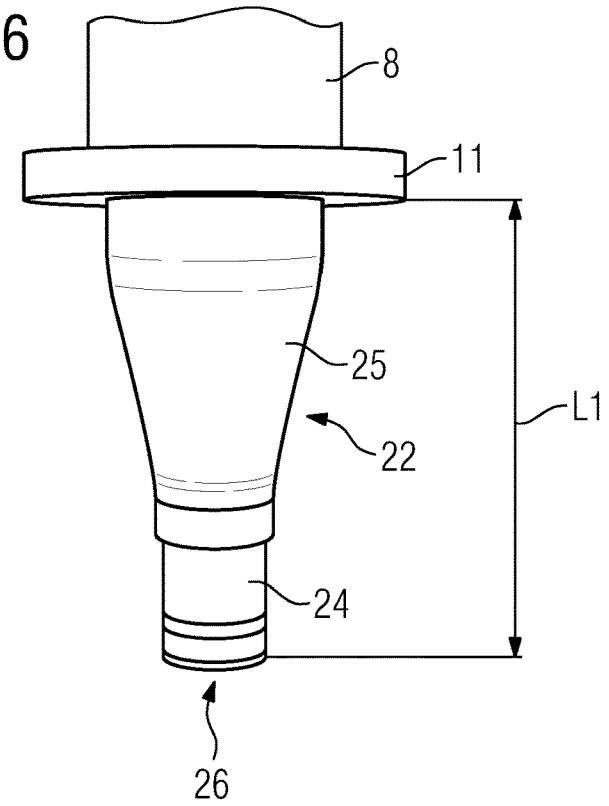
FIG. 6 shows the plug-in section of the high voltage conductor and the fixing section and FIG. 7 shows an example of embodiment of the conductor plug-in socket in a view from above.
Figure 7:
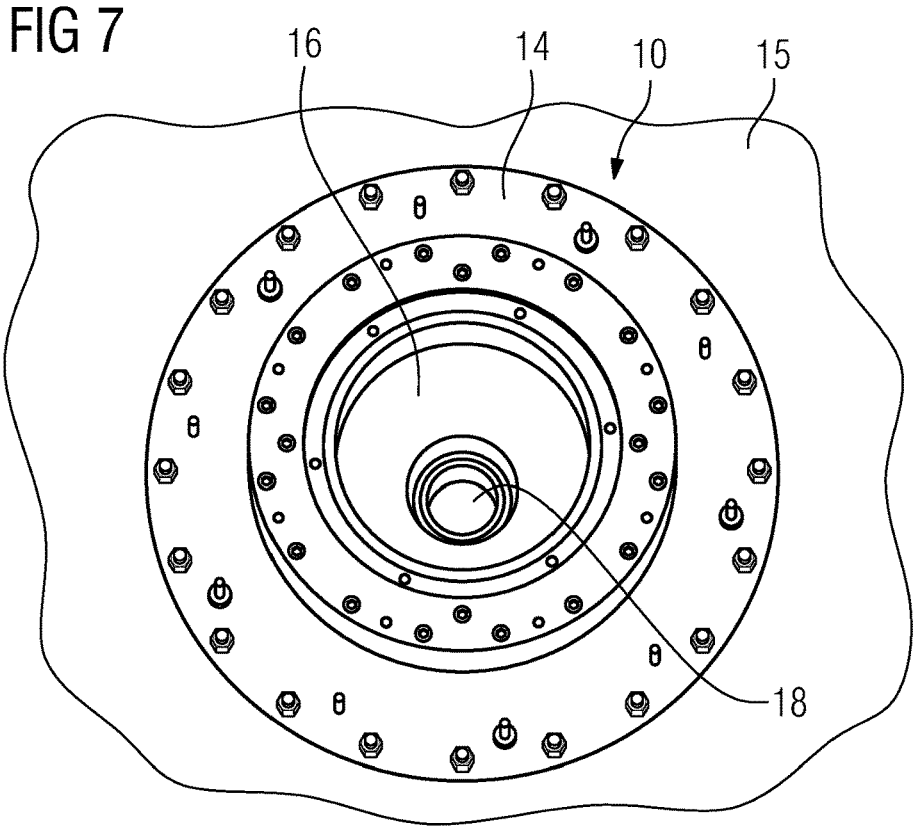

FIG. 6 illustrates plug-in section 22 of high voltage conductor 8 by way of example for all high voltage conductors 6, 7, 8 in a side view. In this view, it can in particular be seen that high voltage conductor 8 comprises a high-voltage conducting element 24, which extends from high-voltage terminal 13 at the other free end of high voltage conductor 8 through the entire insulating body of high voltage conductor 8. In an inserted position, high-voltage conducting element 24 enters at its lower end 26 into contact with contact part 18 of conductor plug-in socket 10. Moreover, fixing section 11 of high voltage conductor 8 is sketched in rough outline, being constituted as a flange in the shown example of embodiment. Flange 11 can be connected rigidly by a screw-type connection to housing cover 15. Distance L1 between lower end 26 and fixing section 11 is advantageously less than 600 mm.

Plug-in section 22 comprises a sheathing 25 of a viscous insulator, which closes off plug-in section 22 to the exterior, wherein high-voltage conducting element 24 alone projects out of sheathing 25. Once plug-in section 22 has been introduced, the viscous insulator of sheathing 25 lies adjacent to the inner side of receiving section 16, wherein viscous sheathing 25 fills free spaces between the plug-in socket and the plug-in section of the high voltage conductor, so that air inclusions and therefore high electrical field strengths are prevented.

FIG. 6 shows rotation-symmetrical plug-in socket 10 from above. In this view, housing cover 15 and fixing section 14 of plug-in socket 10, in particular, can be seen particularly well. Fixing section 14 is again constituted as a standard flange connection, wherein it can also be seen that receiving section 16 extends from fixing section 14 downwards, i.e. into oil chamber or internal space 19, wherein receiving section 16 tapers towards a closed end. Contact part 18 can be seen at the closed end. Contact part 18 is constituted as a sleeve and thus closed at one side. The internal diameter of sleeve 18 is somewhat greater than the external diameter of conducting element 24, wherein spring-loaded contact finders provide a sufficiently good electrical contact. Receiving section 16 comprises a wall made of an insulating material, which is not electrically conductive. During operation, contact part 18 is at a high-voltage potential, wherein housing 2 and therefore also housing cover 15 and fixing section 14 are at earth potential.

The invention claimed is:

1. An electrical appliance for connection to a high-voltage network, the electrical appliance comprising:

a housing to be filled with insulating liquid, and a core with at least one winding disposed in said housing;

a bushing plug-in socket fixed to said housing, said bushing plug-in socket including a fixing section for fixing to said housing, a hollow receiving section made of an electrically non-conductive insulating material extending from said fixing section into said housing, a metallic contact part being disposed at a closed tapered end region, and said metallic contact part extending through said insulating material of said receiving section or lengthening said receiving section to said closed end region; and a high-voltage bushing configured for insertion into said bushing plug-in socket, said high-voltage bushing including a fixing section for affixing said high-voltage bushing to one or both of said housing or said bushing plug-in socket and a column section extending from said fixing section in a longitudinal direction over a length L2 towards a high-voltage terminal, said length L2 being greater than three meters.

2. The electrical appliance according to claim 1, wherein said high-voltage bushing, introduced into said bushing plug-in socket, extends with a plug-in section in the longitudinal direction into said bushing plug-in socket over a length L1, said length L1 being less than 600 mm.

3. The electrical appliance according to claim 1, which comprises a winding connecting line extending inside said housing and connecting said contact part to said at least one winding of said core.

4. The electrical appliance according to claim 3, wherein said winding connecting line is provided with a current transformer.

5. The electrical appliance according to claim 1, wherein said plug-in section of said high-voltage bushing comprises a sheathing of a viscous insulator, and wherein a high-voltage conducting element extends through said sheathing at a free end of said plug-in section.

6. The electrical appliance according to claim 1, wherein said bushing plug-in socket is one of three bushing plug-in sockets fixed to said housing and said high-voltage bushing is one of three high-voltage bushings each configured for insertion into a respective one of said three bushing plug-in sockets.

* * * * *